US005230109A

United States Patent [19]

Zaccai et al.

[11] Patent Number: 5,230,109

[45] Date of Patent: Jul. 27, 1993

[54] VERTICALLY ADJUSTABLE LAVATORY ASSEMBLY

[75] Inventors: Gianfranco Zaccai, Boston; James M. Stark, Millbury; Timothy C. Dearborn, Wellesley; Christopher Chiodo, Brookline, all of Mass.

[73] Assignee: Herman Miller, Inc., Zeeland, Mich.

[21] Appl. No.: 848,415

[22] Filed: Mar. 6, 1992

[51] Int. Cl.[5] ..... E03C 1/324

[52] U.S. Cl. ..... 4/645; 4/643

[58] Field of Search ..... 4/263, 643, 645; 312/226, 227, 228, 246, 247, 297, 298, 272, 272.5; 160/84.1

[56] References Cited

U.S. PATENT DOCUMENTS

| | | | |
|---|---|---|---|
| D. 168,317 | 12/1952 | Rothenstein | D4/2 |
| D. 190,795 | 7/1961 | Rancorn | D4/4 |
| D. 197,946 | 4/1964 | Tiller | D4/2 |
| D. 199,048 | 9/1964 | Tiller | D4/2 |
| D. 219,341 | 12/1970 | Jacoby et al. | D23/49 |
| D. 233,149 | 10/1974 | Campbell | D23/49 |
| D. 233,837 | 12/1974 | Brady | D23/49 |
| D. 251,065 | 2/1979 | Campbell | D23/49 |
| D. 251,732 | 5/1979 | Kaan | D23/49 |
| D. 252,035 | 6/1979 | Morris et al. | D23/49 |
| D. 252,036 | 6/1979 | Morris et al. | D23/49 |
| D. 252,037 | 6/1979 | Morris et al. | D23/49 |
| D. 252,038 | 6/1979 | Morris et al. | D23/49 |
| D. 252,039 | 6/1979 | Morris et al. | D23/49 |
| D. 252,040 | 6/1979 | Morris et al. | D23/49 |
| D. 252,098 | 6/1979 | Morris et al. | D23/49 |
| D. 252,099 | 6/1979 | Morris et al. | D23/49 |
| D. 252,100 | 6/1979 | Morris et al. | D23/49 |
| D. 265,235 | 6/1982 | Keller | D23/49 |
| D. 281,714 | 12/1985 | Morris | D23/49 |
| D. 288,709 | 3/1987 | Campbell | D23/49 |
| D. 288,710 | 3/1987 | Campbell | D23/49 |
| 1,060,106 | 4/1913 | Mailette et al. | |
| 1,071,324 | 8/1913 | Lane | |
| 1,391,091 | 9/1921 | Arbuckle | |
| 2,552,546 | 5/1951 | Fergusson | 4/3 |
| 2,611,134 | 9/1952 | Jarrett et al. | 4/10 |
| 2,716,757 | 9/1955 | Eriksson | 4/166 |
| 2,787,027 | 4/1957 | Baker | 20/1.11 |
| 2,817,094 | 12/1957 | Lessley | |
| 3,011,177 | 12/1961 | Haughey | |
| 3,111,076 | 11/1963 | Martin, Jr. et al. | 160/84.1 |
| 3,118,147 | 1/1964 | Larkin | |
| 3,456,264 | 7/1969 | Flagg | |
| 3,473,173 | 10/1969 | Maciulaitis et al. | |
| 3,486,175 | 12/1969 | Schwartz | |
| 3,502,384 | 3/1970 | Gipson | |
| 3,627,396 | 12/1971 | Miller | 312/229 |
| 4,233,692 | 11/1980 | Sinsley | 4/662 |
| 4,233,693 | 11/1980 | Stocklöw | 4/644 |

FOREIGN PATENT DOCUMENTS 169620 12/1951 Fed. Rep. of Germany .

OTHER PUBLICATIONS

"The Electronic Kitchen and Bath . . . ", Electronic House magazine article (Oct. 1990).

"Granburg Conquers Kitchen and Bath Barriers", Electronic House magazine article (Oct. 1990).

"Quality and Convenience with A Beautiful Sink with the Built-in Lift!" product brochure (date unknown).

*Primary Examiner*—Henry J. Recla

*Assistant Examiner*—Charles R. Eloshway

*Attorney, Agent, or Firm*—Willian Brinks Olds Hofer Gilson & Lione

[57] ABSTRACT

A vertically adjustable lavatory assembly includes an outer frame and a carrier frame positioned within the outer frame. The carrier frame is vertically moveable within the outer frame and has a lavatory connected thereto. A lavatory is positioned outside the carrier frame and outer frame, and includes a faucet and a sink basin having an outlet opening therein. A drain line is in fluid flow communication with the sink basin outlet opening and a sewer line, and is adapted to accommodate for changes in the height of the sink basin. A plurality of supply lines are provided for supplying water to the faucet. The supply lines are also adapted to accommodate for changes in the height of the basin.

44 Claims, 6 Drawing Sheets

10
60
6
70
125
72
85
86
24
84
76
128
56
92
88
80
66
64
128
22
138
21
18
112
114
108
100
54
64
98
126
78
96
110
16
126
122
122
144
48
50
50
149
149
20
34
158
32
158
34
14
30
42
192
42
38
180
190
40
188
40
178
184
23
168
186
172
165
165
166
128
26
128
28
6

FIG. 7
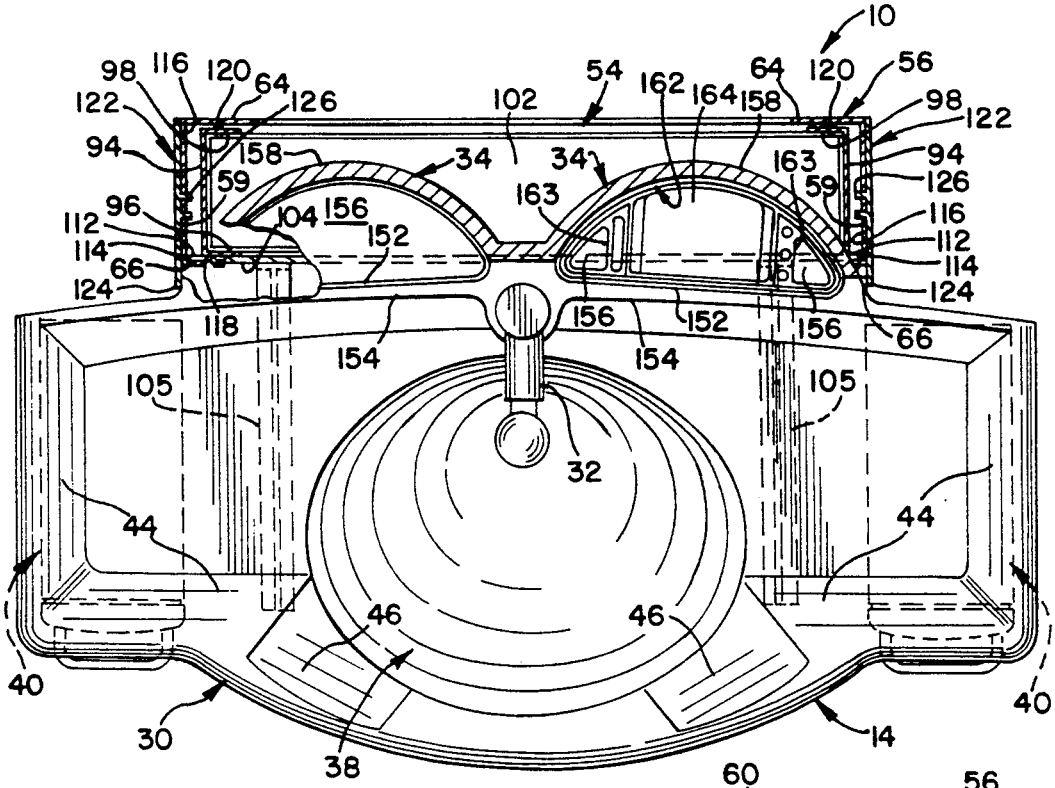
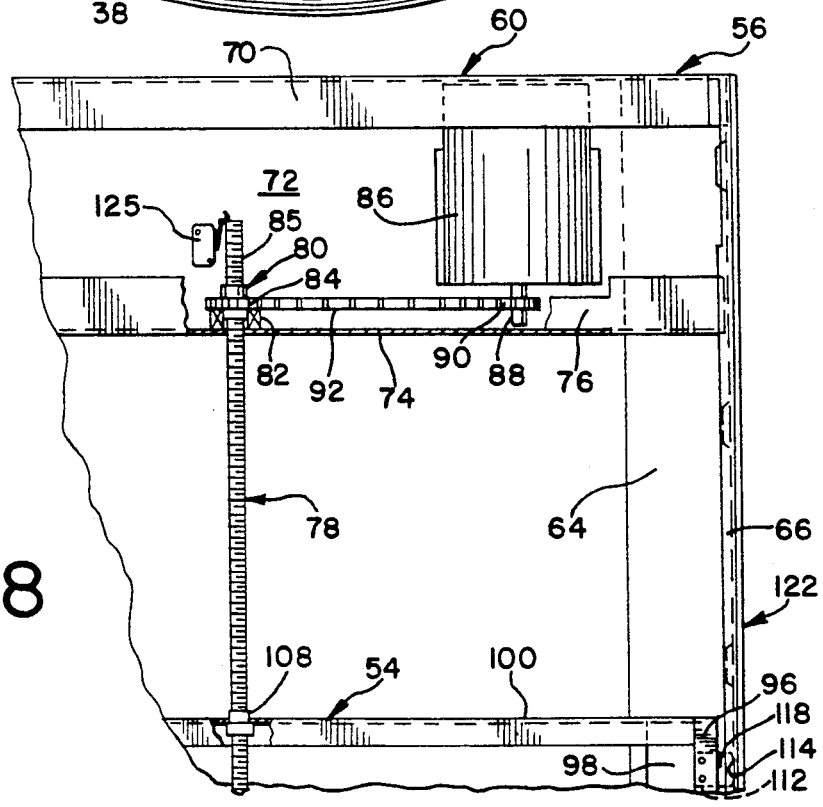
FIG. 8

VERTICALLY ADJUSTABLE LAVATORY ASSEMBLY

BACKGROUND OF THE INVENTION

The present invention relates generally to lavatories, and more particularly, to a vertically adjustable lavatory.

A vertically adjustable lavatory is desirable to allow convenient use by people of various heights, and is especially convenient for wheelchair users who must sit while using the lavatory. Furthermore, small children may risk falling from a device such as a stool when boosting themselves up to the height of a conventional lavatory. In the past, some lavatories have been designed to be vertically adjustable by hand operated jacks, hydraulic pressure, electric motors, and/or various other types of mechanical devices, gears, and linkages. Typically, the drain lines of these systems are flexible or telescoping to accommodate for the vertical movement of the sink. Vertically adjustable lavatories of this type are disclosed in U.S. Pat. Nos. 1,060,106 (McGregor), 1,391,091 (Arbuckle), 2,716,757 (Erikson), 2,817,094 (Lessley), 3,011,177 (Haughhey), 3,118,147 (Larkin), 3,456,264 (Flagg), 3,473,173 (Maciulaitis), 3,486,175 (Schwartz), 3,502,384 (Gipson), and 4,233,693 (Stocklow).

Gipson discloses a sink which is slidably mounted between a pair of cabinets. A chair is positioned underneath the sink to provide a seat for using the sink in a lowered position.

Schwartz discloses a height adjustable washbasin that is slidably mounted by two pairs of rollers to a pair of channel-shaped tracks which are secured within a wall to studs or the like. One embodiment of the Schwartz apparatus shows a basin mounted to a telescoping track and slide assembly including slides disposed in channel-shaped intermediate sliding tracks which, in turn, are slidably disposed in channel-shaped fixed tracks. The lavatory in Schwartz may be elevated either hydraulically or electrically.

In U.S. Pat. No. 3,118,147, a mounting plate is attached to a wall and has inwardly facing tracks at opposite sides thereof. A sink support structure having outwardly facing tracks and an L-shaped bracket slides vertically on rollers positioned between the tracks. A rear edge of a sink is mounted on the L-shaped bracket of the sink support structure such that the sink moves vertically with the sink support structure.

Lessley discloses a vertically adjustable lavatory including a frame received within a recess in a wall. The lavatory is supported on a pair of brackets which are mounted to threaded elevating screw elements such that the lavatory is height adjustable relative to the frame.

In U.S. Pat. No. 3,473,173, a height adjustable lavatory includes a pair of shafts extending vertically from the base of a frame, a cantilevered arm assembly slidably connected to the shafts, a base cabinet assembly including a table and basin mounted to the arm assembly, and an upright cabinet assembly mounted to the base cabinet assembly. The upper cabinet assembly, which can include a mirrored medicine cabinet or the like, is also mounted to the arm assembly by a vertical sub-frame such that both the upper and base cabinet assembly are vertically adjustable in unison. A telescoping skirt assembly is connected to the base cabinet assembly and the base of the frame to provide an enclosure which expands and contracts in response to the vertical movement of the lavatory. The lavatory may be height adjustable either hydraulically or electrically, and a flexible hose coupling is provided to accommodate for the vertical movement of the basin.

SUMMARY OF THE INVENTION

Briefly stated, the invention is directed to a vertically adjustable lavatory assembly including a carrier frame positioned within an outer frame. The carrier frame is vertically moveable within the outer frame and has a lavatory connected thereto. The lavatory is positioned substantially outside the carrier frame and outer frame, and includes a faucet and a sink basin having an outlet opening therein. The vertically adjustable lavatory assembly includes means for vertically moving and guiding the carrier frame within the outer frame. A drain line is in fluid flow communication with the sink basin outlet opening and a sewer line, and is adapted to accommodate for changes in the height of the sink basin. A plurality of water supply lines are also adapted to accommodate for changes in the height of the basin.

In a preferred embodiment, the sink basin depends from a substantially horizontal counter for resting a person's arms or various articles thereon, and lower cabinets depend from lateral edge portions of the counter. An upper cabinet including a mirror is attached to the carrier frame and is positioned substantially inside said carrier frame above the counter. Upper and lower collapsible bellows having a width substantially the same as the outer frame are provided to cover the outer frame and any exposed components therein. Preferably, the upper bellows are adapted to interconnect an upper portion of the upper cabinet to an upper portion of the outer frame, and the lower bellows are adapted to interconnect a lower portion of the lavatory to a lower portion of the outer frame.

The drain line includes a rigid portion connected to the outlet opening in the basin and a flexible portion connected to a sewer line. The rigid portion preferably has a first segment extending downward from the sink basin outlet opening, a substantially horizontal second segment extending rearwardly from said first segment, and a trap-forming segment extending from said second segment. The second horizontal segment is substantially adjacent a bottom surface of the basin, and the trap-forming segment is positioned substantially within the outer frame to provide maximum clearance between the drain line and a floor. The trap-forming segment preferably has a first section extending downward from the second segment and a second section curving in a lateral direction away from the first section and bending upward.

The means for moving the carrier frame preferably comprises a motor attached to an upper portion of the outer frame and a jack screw driven by said motor. The jack screw has a top end portion rotatably attached to a horizontal cross-member of the outer frame and a bottom end portion adapted to threadably mate with an aperture in the carrier frame. In addition, the means for guiding the carrier frame vertically within the outer frame preferably comprises side pieces connected to said carrier frame which slidably bear against side wall flanges of the outer frame.

The present invention provides significant advantages over other vertically adjustable lavatories. The carrier frame provides a single structure for mounting the lavatory and various other components thereon. Thus, the various components connected to the carrier frame move uniformly as a unit with the carrier frame. The moving means are simple, inexpensive and reliable since the load from the lavatory and other components is distributed through the carrier frame, thus allowing the moving means to cooperate with the carrier frame at a single location.

In addition, the preferred configuration of the drain line provides maximum clearance between the sink basin and a floor to allow the lavatory to be lowered to a comfortable position for a person sitting in a chair or wheelchair. The horizontal segment of the drain line is positioned substantially adjacent the bottom surface of the basin and the height of the carrier frame allows the moving means to be positioned adjacent an upper portion of the outer frame. Thus, sufficient space is provided within the outer frame and below the basin for the trap-forming segment of the drain line to be completely disposed therein.

Furthermore, upper and lower collapsible bellows provide an attractive cover for concealing the outer frame and any exposed components therein. Thus, the lavatory and any other components attached to the carrier frame such as a cabinet and/or mirror move as a unit to a desired vertical location, and one bellows expands while the other collapses to provide an attractive, convenient, vertically adjustable lavatory.

The present invention, together with further objects and advantages, will be best understood by reference to the following detailed description taken in conjunction with the accompanying drawings.

BRIEF DESCRIPTION OF THE DRAWINGS

FIG. 7 is a cross-sectional view of the invention shown in FIG. 6 taken along the line 7—7.

FIG. 8 is a fragmentary exploded view of a jack screw and motor assembly.

DETAILED DESCRIPTION OF THE PREFERRED EMBODIMENTS

Figure 1:
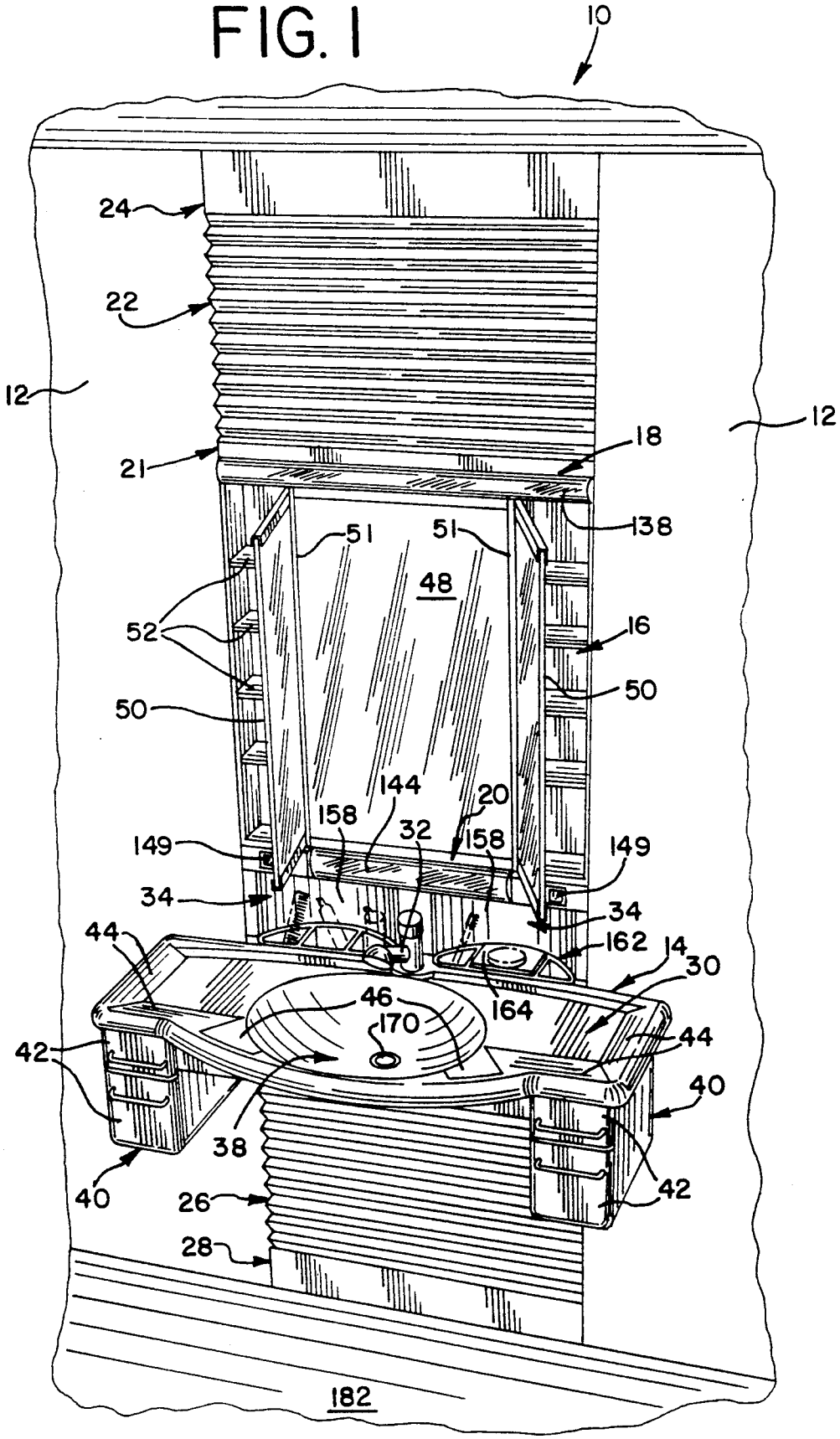
FIG. 1 is a perspective view of a preferred embodiment of the invention showing a lavatory in a lowered position.
Figure 2:
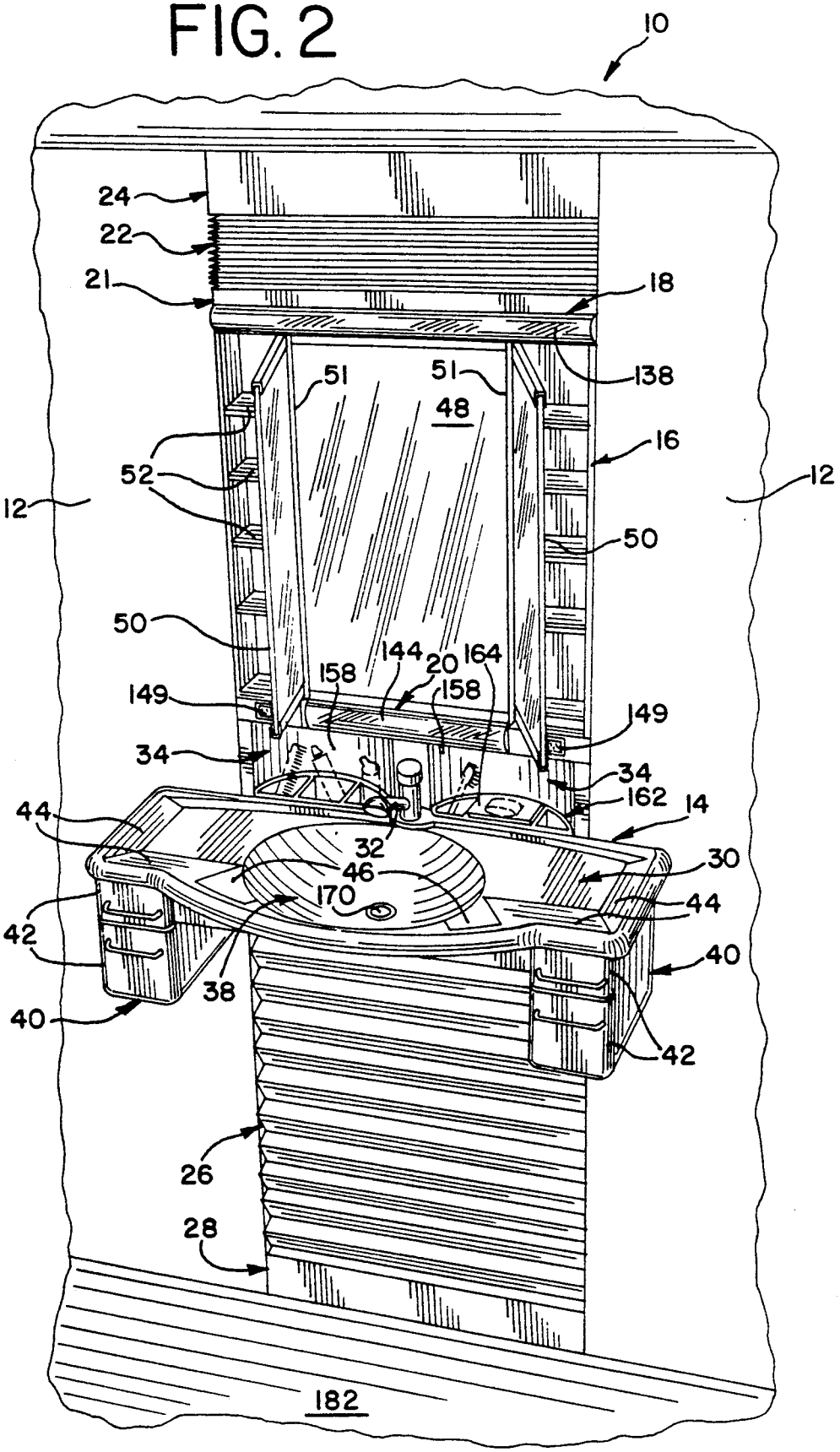
FIG. 2 is a perspective view of the invention in FIG. 1 showing the lavatory in a raised position.

Referring to the drawings, FIG. 1 and 2 show a preferred embodiment of a vertically adjustable lavatory assembly indicated generally at 10 as installed in a recess formed in a wall 12 of a bathroom. The lavatory assembly 10 preferably includes a lavatory 14, an upper cabinet 16, an upper light assembly 18, a lower light assembly 20, and middle front panels 21 and 23, all of which are vertically movable between a lowered position (FIG. 1) and a raised position (FIG. 2). An upper collapsible bellows 22 completely conceals the space between a fixed upper front panel 24 and the middle panel 21, and a lower collapsible bellows 26 completely conceals the space between a fixed lower front panel 28 and the middle panel 23 (FIGS. 5-6) when the movable components are in any vertical position.

Figure 3:
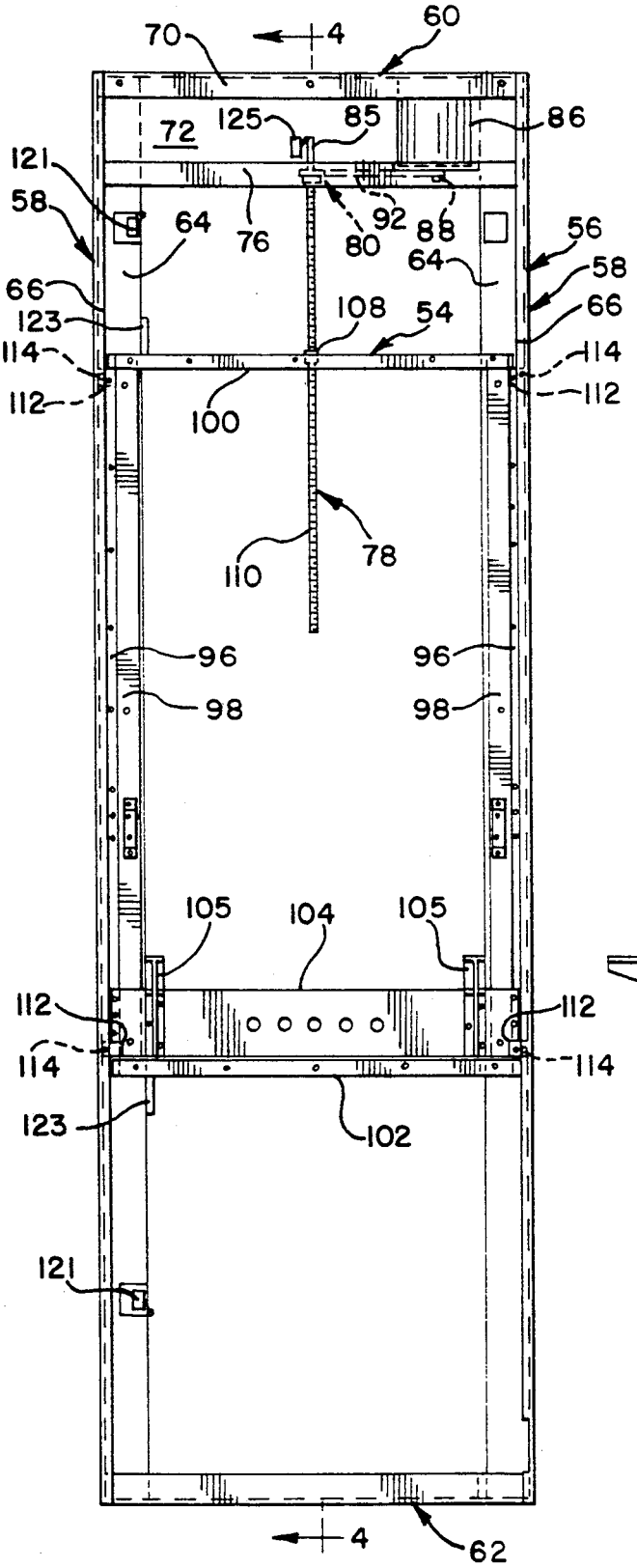
FIG. 3 is front view of a preferred embodiment of the invention with various components removed for clarity.
Figure 4:
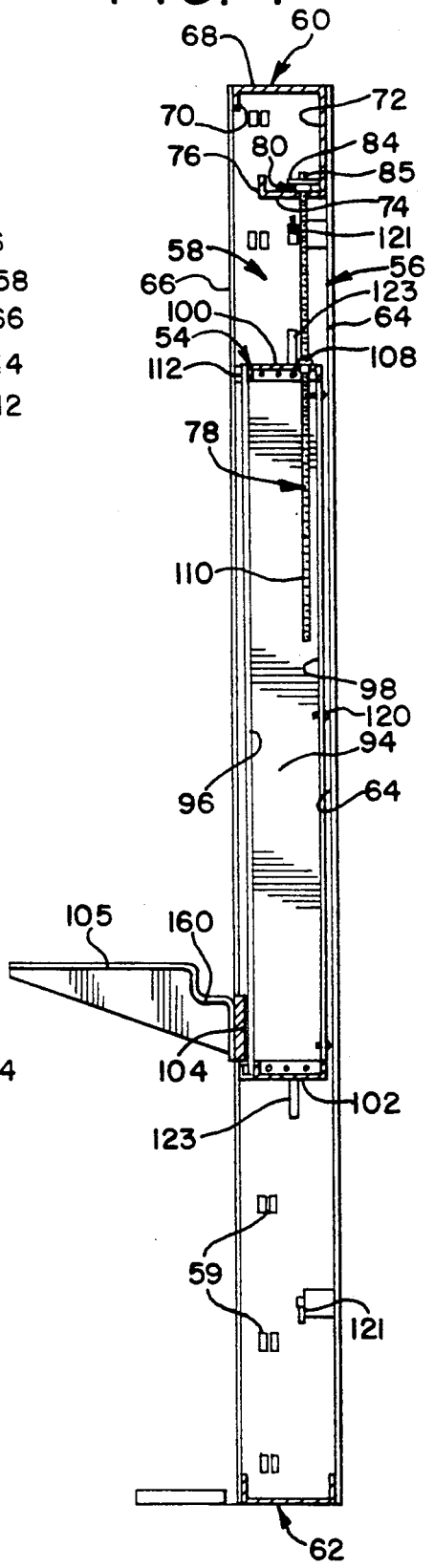
FIG. 4 is a cross-sectional view of the components shown in FIG. 3 taken along the line 4—4.

The lavatory 14 preferably includes a horizontal counter 30, a faucet 32, receptacles 34, a sink basin 38, and lower cabinets 40 having a plurality of drawers 42 therein. The counter 30 has sloped edge portions 44 to prevent water from draining onto a floor and indentations 46 therein formed at an angle relative to the wall 12 for comfortably placing a person's forearms thereon. The upper cabinet 16 is positioned higher than the counter 30 and preferably includes a center mirror 48, pivotable lateral mirrors 50, and a plurality of shelves 52 therein. To provide side views for a user, the lateral mirrors 50 are hinged adjacent side edges 51 of the center mirror and pivot toward the user. The upper cabinet 16 can include a single mirror or any number of mirrors with or without shelves therein, and any number of mirrors can be provided without the upper cabinet. The lower cabinets 40 can comprise any desirable storage device such as waste bins or the like, and can be configured with other desirable features such as towel bars. In FIGS. 3-4, a carrier frame 54 is shown positioned within an outer frame 56. The outer frame 56 is preferably rectangular and is adapted to be positioned completely within a recess formed in the wall 12 as shown in FIGS. 1 and 2, although the outer frame 56 can extend outwardly from the wall 12. The outer frame 56 can comprise any suitable configuration which is mountable to the wall 12 and adapted to support the weight of the carrier frame 54 and its connected components. The outer frame 56 can also be configured in various ways to provide sufficient bearing surfaces for retaining the carrier frame 54 and it connected components when they are stationary as well as during vertical movement thereof.

Preferably, the outer frame 56 includes vertical side walls 58 having a plurality of vertically aligned apertures 59 therein, a top cross-member 60, and a bottom cross-member 62 positioned horizontally between the side walls 58. Rear flanges 64 extend inwardly from rear edges of the side walls 58, and front flanges 66 extend inwardly from front edges of the side walls 58. The top cross-member 60 preferably has a horizontal plate 68, a front vertical flange 70 extending downward from a front edge thereof, and a back vertical plate 72 extending downward from a rear edge thereof. A horizontal flange 74 having a hole therein (not shown) extends forwardly from the back plate 72, and a vertical flange 76 extends upwardly from the horizontal flange 74.

To allow rotation of a jack screw 78 which supports the carrier frame 54, a bearing assembly 80 is mounted to the horizontal flange 74 of the top cross-member 60 and includes a plurality of thrust bearings 82 (FIG. 8). A pulley 84 is attached to a top portion 85 of the jack screw 78 and extends downward through the hole (not shown) in the horizontal flange 74 of the top cross-member 60. A motor 86, preferably 1/9 HP, is mounted to the back plate 72 of the top cross-member 60 and includes a drive shaft 88 extending vertically downward therefrom. The shaft 88 has a pulley 90 attached thereto at approximately the same height as the jack screw pulley 84. To rotate the jack screw 78 and raise or lower the carrier frame 54 within the outer frame 56, a belt 92 cooperates with the motor pulley 90 and the jack screw pulley 84 when the motor 86 is actuated control means (not shown).

The motor 86 and bearing assembly 80 can be mounted to any suitable support piece and the top cross-member 60 of outer frame 56 can be configured in various ways to provide a sufficient mounting surface. Other means can be provided for supporting the carrier frame 54 and moving the carrier frame vertically, such as using a motor, hydraulic pressure or the like to drive a plurality of jacks or various other types of mechanical devices, gears, and linkages. However, the use of an electric motor to drive a single jack screw which is located in an upper rear portion of the space defined by the outer frame 56 and threadably attached to the carrier frame 54 at a single location provides a safe, reliable, easily maintainable system which requires little space and can fit within the compact outer frame 56. As will be appreciated in the following description, such a configuration also allows the upper cabinet 16 to extend rearwardly and increases the range of vertical movement of the carrier frame 56 and lavatory 14. Since the jack screw 78 and motor 86 are positioned in a top rear portion of the outer frame 56, more clearance is provided below the lavatory 14. As a result, the lavatory 14 can be lowered to approximately 22 inches from a floor. In addition, the range of vertical travel of the lavatory 14 is approximately 20 inches.

The carrier frame 54 is preferably rectangular and includes a pair of spaced apart vertical support members 94 having inwardly extending front flanges 96 and rear flanges 98, a top horizontal carriage member 100, a bottom horizontal cross-member 102, and a vertical support bracket 104 mounted to a bottom portion of the front flanges 96. To support the lavatory 14, a pair of spaced apart brace members 105 extend perpendicularly outward from the support bracket 104. The carriage member 100 has a hole therein (not shown) and a nut 108 secured within with the hole. A bottom portion 110 of the jack screw 78 threadably mates with the nut 108 and extends therethrough a sufficient length to hold the carrier frame 54 when the lavatory 14 is in the lowest desired position. Thus, rotation of the jack screw 78 in one direction raises the entire carrier frame 54 and its connected components, and rotation of the jack screw 78 in the opposite direction lowers the carrier frame 54 and its connected components.

To guide the carrier frame 54 within the outer frame 56, a plurality of side pieces 112 extend laterally outward from the front flanges 96 of the carrier frame support members 94. As best shown in FIGS. 7 and 8, end portions 114 of the side pieces 112 slidably bear against an inside surface 116 of the outer frame side walls 58, and front surface portions 118 slidably bear against the front flanges 96 of the outer frame side walls 58. To further guide the carrier frame 54, a plurality of posts 120 extend perpendicularly from the carrier frame rear flanges 98 in a rearward direction for slidably bearing against the outer frame rear flanges 64. The side pieces 112 and posts 120 are preferably made of a lubricous, tough plastic such as nylon, polyethylene, Delrin®, or the like. Any number of side pieces can be mounted to the carrier frame 54, although it is desirable to have at least four side pieces mounted to the corners of the carrier frame 54.

The carrier frame 54 can comprise any configuration which provides suitable mounting surfaces for the lavatory 14, cabinet 16, and/or any other desired components. The carrier frame 54 can also be configured in any manner which provides sufficient bearing surfaces for guiding the carrier frame 54 within the outer frame 56. For example, the flanges 96 and 98 of the carrier frame support members 94 or the flanges 64 and 66 of the outer frame side walls 58 can be provided with a bushing such as polyethylene tape or the like to allow the carrier frame flanges to slidably bear against the outer frame flanges. Furthermore, the side pieces 112 can be configured with bearing posts for guiding the carrier frame 54 within the outer frame 56.

To limit the vertical travel of the carrier frame 54 within the outer frame 56, a plurality of limit switches 121 are employed. Preferably, the limit switches 121 are mounted to the outer frame 56 in positions corresponding to the mechanical limit of the carrier frame's travel in each vertical direction. Actuation rods 123 are also mounted to the carrier frame 54 in alignment with a corresponding limit switch 121. Thus, the motor 86 is deactivated and the carrier frame 54 stops moving when the actuation rods 123 contact a corresponding limit switch 121. Since the carrier frame 54 has reached its limit of travel in that direction, it can only move in the opposite direction.

In addition, a limit switch 125 is positioned adjacent an upper end of the jack screw 78. When the carrier frame 54 and its connected components are impeded from moving in a downward direction by a person or object, the jack screw 78 is forced upward to actuate the limit switch 125, thus causing the carrier frame 54 and its connected components to stop. In such an event, the system can only be reactivated in the upward direction.

Figure 5:
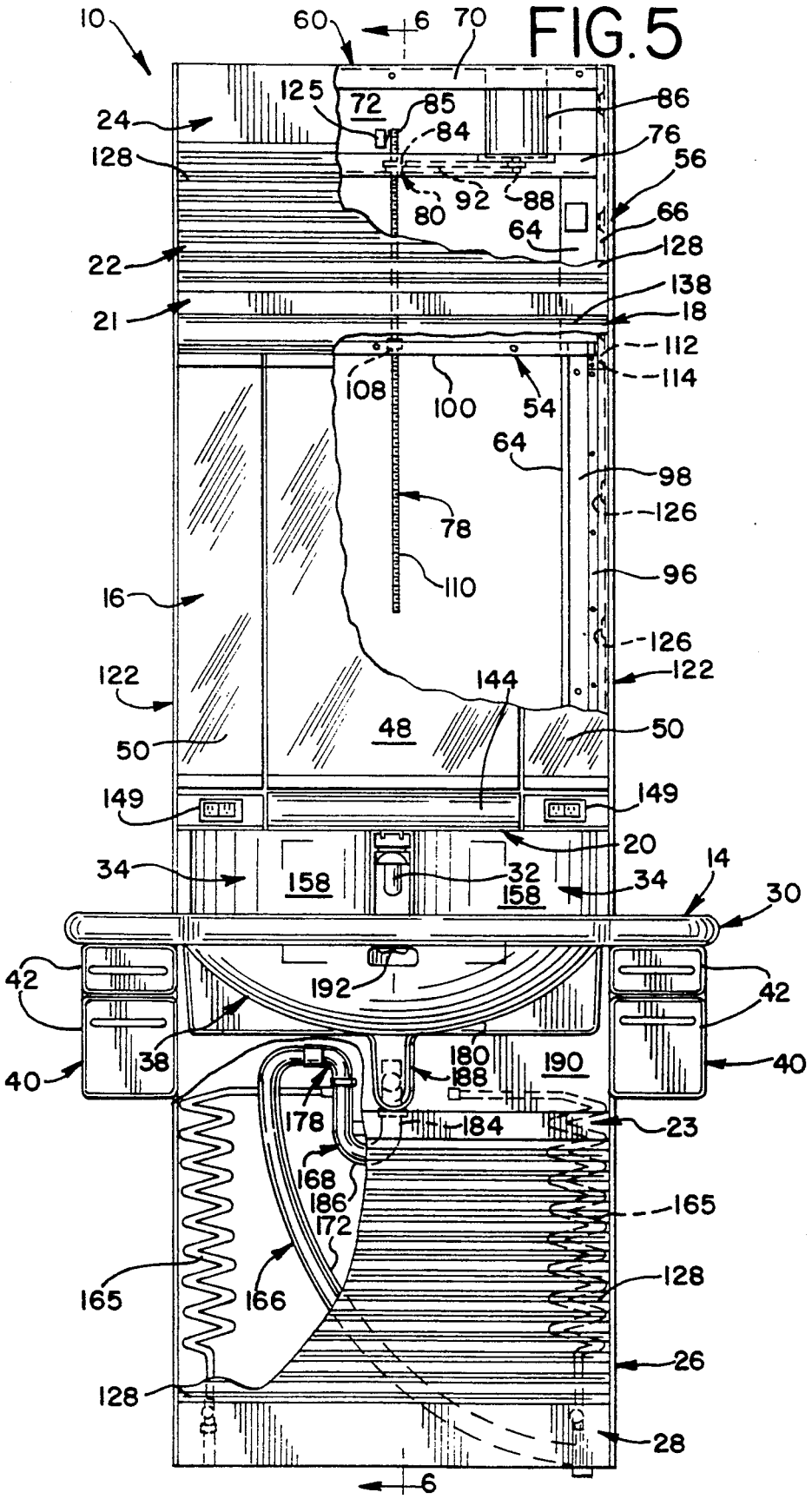
FIG. 5 is a front view of a preferred embodiment of the invention.
Figure 6:
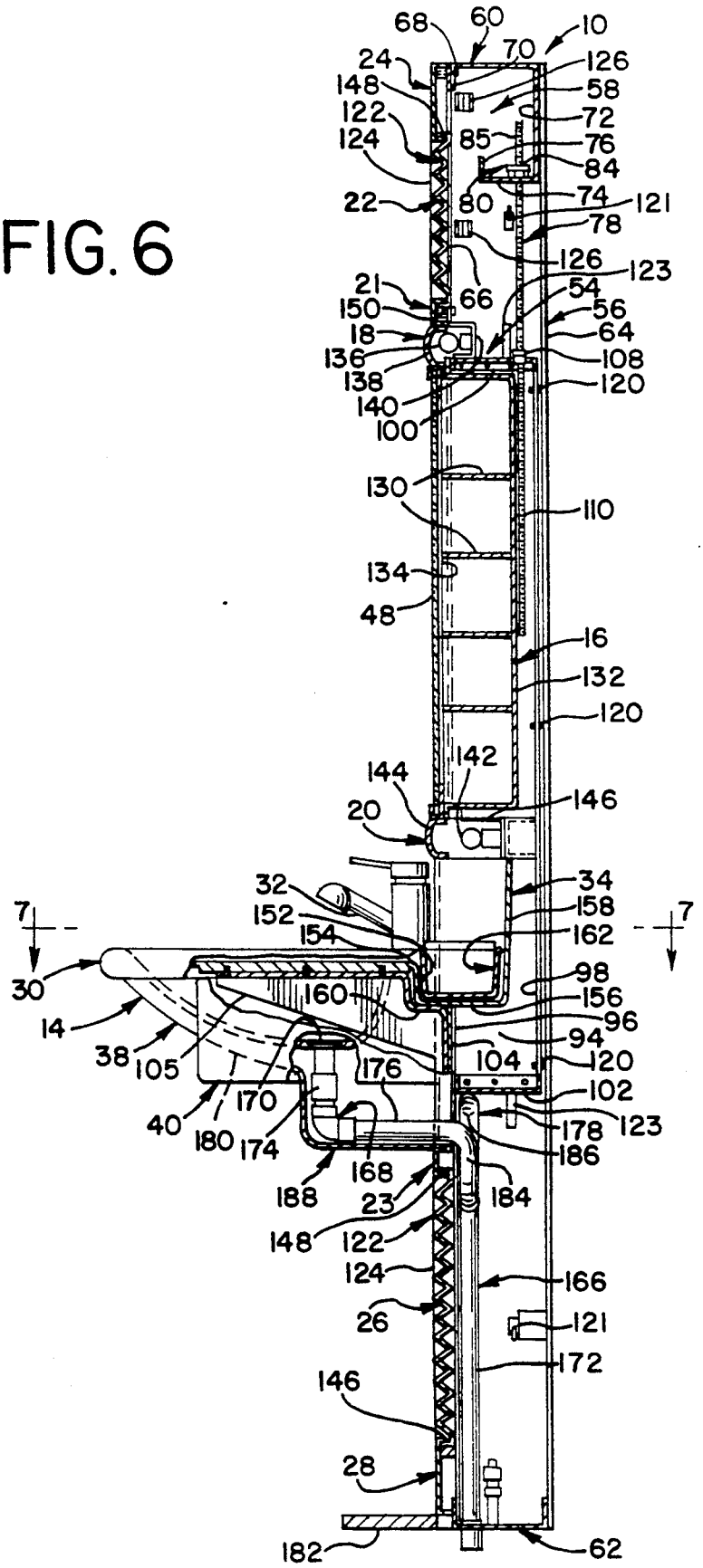
FIG. 6 is a cross-sectional view of the invention shown in FIG. 5 taken along the line 6—6.

In FIGS. 5–7, the lavatory 14, upper cabinet 16, upper and lower light assemblies 18 and 20, upper and lower bellows 22 and 26, middle panels 21 and 23, and upper and lower front panels 24 and 28 are shown connected to the carrier frame 54 and outer frame 56. To conceal edge portions of the foregoing components and guide the moving components within the outer frame 56, side panels 122 are removably attached to the outer frame side walls 58. The side panels 122 have a front edge 124 extending forward past the side wall front flanges 66, and a plurality of inserts 126 extending inward therefrom for insertion into the side wall apertures 59 to secure the side panels 122 to the side walls 58. The side panels 122 can be mounted to the outer frame 56 by any conventional fastening means.

The upper and lower bellows 22 and 26 are substantially planar and have a plurality of horizontal creases therein to allow the bellows to expand and collapse. The bellows 22 and 26 have a width approximately the same as the distance between the outer frame side panels 59, and lateral edge portions 128 of the bellows 22 and 26 are further guided by the outer frame front flanges 66. Preferably, the bellows 22 and 26 are made of polyvinyl chloride or other suitable flexible material.

As best shown in FIG. 6, the upper cabinet 16 is mounted to the carrier frame 54 and is positioned substantially inside the carrier frame 54 and outer frame 56. The upper cabinet 16 includes a plurality of shelves 130, a back wall 132 adjacent the jack screw 78, and a front frame 134. The front frame 134 is approximately the same width as the distance between the outer frame side panels 122 to guide the upper cabinet 16 within the outer frame 56. The upper cabinet 16 can be any suitable shape and can include any number of shelves, partitions, drawers, receptacles, or the like.

The upper light assembly 18 is positioned above the upper cabinet 16 and includes a light 136 and a translucent lens 138 attached to a bracket 140 which is mounted to the carrier frame carriage member 100. The lower light assembly 20 is positioned below the upper cabinet 16 and similarly includes a light 142 and a translucent lens 144 attached to a bracket 146 which is mounted to the carrier frame 54. In addition, an electrical outlet 147 and light switch 149 are positioned adjacent end portions of the lower light assembly 20.

The middle panel 21 is attached to a top portion of the upper light assembly 18 and the upper front panel 24 is fixed to the top cross-member 60 of the outer frame 56. An upper portion 148 of the upper bellows 22 is secured to a lower portion of the upper panel 24, and a lower portion 150 of the upper bellows is secured to the middle panel 21. Thus, the upper bellows 22 collapses when the carrier frame 54 and middle panel 21 are raised and expands when the carrier frame 54 and middle panel 21 are lowered to completely conceal the space between the upper panel 24 and the middle panel 21 when the carrier frame and its connected components are in any vertical position.

Referring again to FIGS. 6–8, the lavatory counter 30 is shown mounted to the brace members 105 extending outward from the carrier frame 54. The counter 30, sink basin 38, and lower cabinets 40 are positioned outside the carrier frame 54 and outer frame 56, and the receptacles 34 are positioned behind the counter 30 and substantially within the carrier frame 54 and outer frame 56. The receptacles 34 preferably have a front wall 152 depending from a back edge 154 of the counter 30, a horizontal bottom wall 156, and a curved back wall 158. The back wall 158 preferably extends upwardly beyond the height of the counter 30 and is adapted to be mounted to the lower light assembly 20. The brace members 105 also include a stepped portion 160 which provides clearance for and supports the receptacles 34. Thus, a convenient container is provided for storing various articles such as toothbrushes, hair care products or the like. Preferably, an organizing tray 162 having a desired number of dividers 163 therein removably fits within the receptacles 34. The tray 162 can also include a soap dish 164 which is supported by the divider 163.

To supply water to the faucet 32 and drain water from the basin 38, a pair of flexible supply lines 165 and a drain line 166 are provided. The drain line 166 preferably includes a rigid portion 168 connected to an outlet opening 170 in the basin 38, and a flexible portion 172 connected to a sewer line (not shown). The supply lines 165 are preferably constructed of coiled polyethylene tubing, and the flexible portion 172 of the drain line 166 is preferably constructed of polyvinyl chloride (PVC). The rigid portion 168 has a first segment 174 extending downward from the sink basin outlet opening 170, a horizontal second segment 176 extending rearwardly from the first segment 174, and a trap-forming segment 178 extending from the second segment 176. The second segment 176 is substantially adjacent a bottom surface 180 of the basin 38 to provide maximum clearance between the drain line 166 and a floor 182. The distance between the second segment 176 of the drain line 166 and the bottom surface 180 of the basin 38 is preferably less than two inches. The trap-forming segment 178 includes a first section 184 extending downward from the second segment 176, and a second section 186 curving in a lateral direction away from the first section 184 and bending upwardly.

A shroud 188 extends downwardly from the basin 38 for covering the first and second segments 174 and 176 of the rigid portion 168 of the drain line 166, and a cover 190 extends downwardly from the basin 38 for concealing the remaining portions of the drain line 166. Preferably, a lower edge portion of the cover 190 is mounted to the middle panel 23.

The drain line 166 can be configured in various ways to accommodate for vertical movement of the sink basin 38. The entire drain line 166 can be flexible or a plurality of swivel joints can interconnect a desired number and configuration of segments. In addition, a portion of the drain line 166 can be extensible and/or can telescope to accommodate for changes in the height of the basin 38.

The lower front panel 28 is fixed to the bottom cross-member 62 of the outer frame. A lower portion 146 of the lower bellows 26 is secured to an upper portion of the lower panel 28, and an upper portion 148 of the lower bellows is secured to the middle panel 23. Thus, the lower bellows 26 expands when the carrier frame 54 and middle panel 23 are raised and collapses when the carrier frame 54 and middle panel 23 are lowered to completely conceal the space between the lower panel 28 and the middle panel 23 when the carrier frame and its connected components are in any vertical position.

In operation of the vertically adjustable lavatory assembly 10, a control switch 192 (FIG. 5) is depressed in a first manner to actuate the motor 86 and rotate the jack screw 78 in a desired direction. The rotation of the jack screw 78 within the nut 108 in the carrier frame carriage member 100 moves the entire carrier frame 54 and its connected components in a corresponding vertical direction. Depression of the control switch 192 in a second manner causes rotation of the jack screw 78 in the opposite direction, which moves the carrier frame 54 and its connected components in the opposite vertical direction. If the carrier frame 54 is moved to its mechanical limit in either direction, an actuation rod 123 contacts the corresponding limit switch 121, the carrier frame 54 stops moving and can only be moved in the opposite direction by the control switch 192. In addition, the upper bellows 22 collapses and the lower bellows 26 expands when the carrier frame 54 is raised, and the upper bellows 22 expands and the lower bellows 26 collapses when the carrier frame 54 is lowered. Thus, the space between the fixed upper panel 24 and middle panel 21 and the space between the fixed lower panel 28 and the middle panel 23 is completely concealed when the carrier frame 54 and its connected components are in any vertical position.

Thus, a simple, reliable, easily maintainable, attractive lavatory is provided which is vertically adjustable and provides maximum clearance underneath a sink basin for a person sitting in a wheelchair or the like.

Although the present invention has been described with reference to preferred embodiments, workers skilled in the art will recognize that many changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A vertically adjustable lavatory assembly comprising:

an outer frame having a front edge defining a substantially vertical plane;

a carrier frame positioned within the outer frame and being vertically moveable within said outer frame, said carrier frame slidably engaging said outer frame;

a lavatory including a faucet and a sink basin having an outlet opening therein, said lavatory being connected to the carrier frame and positioned substantially outside said carrier frame and outer frame;

means for vertically moving the carrier frame within the outer frame;

a drain line in fluid flow communication with the sink basin outlet opening and a sewer line, the drain line being adapted to accommodate for changes in the height of the sink basin; and a plurality of supply lines for supplying water to the faucet, the supply lines being adapted to accommodate for changes in the height of the basin.

2. The apparatus of claim 1, wherein the means for moving the carrier frame is positioned above the carrier frame.

3. The apparatus of claim 2, wherein the means for moving the carrier frame comprises a motor and a jack screw driven by said motor, the jack screw having an upper portion rotatably attached to the outer frame and a lower portion adapted to threadably mate with an aperture in the carrier frame, whereby the carrier frame and its connected components move vertically relative to the outer frame when the screw is rotated by the motor.

4. The apparatus of claim 1, wherein the sink basin depends from a substantially horizontal counter adapted for resting a person's arms thereon.

5. The apparatus of claim 4, wherein the counter includes spaced apart lower storage members depending from lateral edge portions thereof.

6. The apparatus of claim 4, further comprising a receptacle positioned behind the counter and substantially within the carrier frame and outer frame.

7. The apparatus of claim 1, further comprising one of a mirror and an upper cabinet positioned above the lavatory and adapted to move vertically with the carrier frame.

8. The apparatus of claim 7, wherein one of the mirror and upper cabinet is positioned substantially inside the carrier frame and is attached thereto.

9. The apparatus of claim 1, further comprising light means adapted to move vertically with the carrier frame.

10. The apparatus of claim 1, further comprising an electrical outlet adapted to move vertically with the carrier frame.

11. The apparatus of claim 1, further comprising collapsible cover means for concealing the outer frame and any exposed components therein, an upper edge portion of said cover means adapted to be attached to the lavatory adjacent an underside of the sink.

12. The apparatus of claim 1, wherein the outer frame has a width defined by spaced apart, vertical side walls, and the cover means comprises upper and lower collapsible bellows having a width substantially the same as the outer frame, said upper bellows being adapted to interconnect an upper portion of the lavatory to an upper portion of the outer frame, and said lower bellows being adapted to interconnect a lower portion of the lavatory to a lower portion of the outer frame, whereby one bellows expands and the other collapses when the lavatory moves vertically, thus concealing the outer frame and any exposed components therein.

13. The apparatus of claim 1, wherein the drain line includes a rigid portion and a flexible portion, the rigid portion having a first segment extending downward from the sink basin outlet opening, a substantially horizontal second segment extending rearwardly from said first segment, and a trap-forming segment extending from said second segment, said trap-forming segment having a downwardly extending portion positioned behind a vertical plane defined by front edges of the outer frame, and said second segment being substantially adjacent a bottom surface of the basin to provide maximum clearance between the drain line and a floor.

14. The apparatus of claim 13, wherein the trap-forming segment of the drain line includes a first section extending downwardly from said second segment substantially within the outer frame, and a second section curving in a lateral direction away from the first section and bending upward, the flexible portion of the drain line extending from the second section of the trap-forming segment.

15. The apparatus of claim 14, wherein the distance between the second segment of the drain line and the bottom surface of the basin is less than two inches.

16. The apparatus of claim 13, wherein the sink basin has a shroud extending downward therefrom for covering the first and second segments of the rigid portion of the drain line, said shroud having a cavity defined by a front wall, a bottom wall, and side walls.

17. The apparatus of claim 1, further comprising means for limiting the range of vertical travel of the carrier frame and means for stopping the downward movement thereof when an object impedes said downward movement.

18. A vertically adjustable lavatory assembly comprising:

an outer frame adapted to be positioned substantially inside a recess in a wall, said outer frame including spaced apart, vertical side walls;

a carrier frame positioned inside the outer frame and being vertically moveable within said outer frame;

a lavatory including a faucet and a sink basin having an outlet opening therein, said lavatory being connected to the carrier frame and positioned outside the carrier frame and outer frame;

one of a mirror and cabinet positioned above the sink basin and adapted to be connected to the carrier frame;

cover means for concealing the outer frame and any exposed components therein;

means for vertically moving the carrier frame within the outer frame;

means for guiding the carrier frame within the outer frame;

control means for actuating vertical movement of the carrier frame;

a drain line including a rigid portion and a flexible portion, the rigid portion having a first segment extending downward from the sink basin outlet opening, a substantially horizontal second segment extending rearwardly from said first segment, and a trap-forming segment extending from said second segment, said trap-forming segment having a downwardly extending portion positioned behind a vertical plane defined by front edges of the outer frame, and said second segment being substantially adjacent a bottom surface of the basin to provide maximum clearance between the drain line and a floor; and a plurality of flexible supply lines for supplying water to the faucet;

whereby the control means is activated to move the carrier frame and its connected components in a desired vertical direction within the outer frame.

19. The apparatus of claim 18, wherein the means for moving the carrier frame is positioned adjacent an upper portion of the outer frame.

20. The apparatus of claim 19, wherein the means for moving the carrier frame comprises a motor attached to the upper portion of the outer frame and a jack screw driven by said motor, the jack screw having a top end portion rotatably attached to a horizontal cross-member of the outer frame and a bottom end portion adapted to threadably mate with an aperture in the carrier frame, whereby the carrier frame and its connected components move vertically relative to the outer frame when the screw is rotated by the motor.

21. The apparatus of claim 18, wherein the sink basin depends from a substantially horizontal counter for resting a person's arms or various articles thereon.

22. The apparatus of claim 21, wherein the counter includes spaced apart lower storage members depending from lateral edge portions thereof.

23. The apparatus of claim 18, further comprising an upper cabinet positioned behind a mirror and substantially inside the carrier frame, said upper cabinet and mirror being adapted to move vertically with the carrier frame.

24. The apparatus of claim 23, further comprising a pair of receptacles positioned below the cabinet and behind the sink basin, said receptacles having a front wall depending from a back edge portion of the basin, a horizontal bottom wall, and a curved back wall, the back walls extending upwardly beyond an uppermost portion of the basin.

25. The apparatus of claim 18, wherein the distance between the second segment of the drain line and the bottom surface of the basin is less than two inches.

26. The apparatus of claim 18, wherein the sink basin has a shroud extending downward therefrom for covering the first and second segments of the rigid portion of the drain line, said shroud having a cavity defined by a front wall, bottom wall, and side walls.

27. The apparatus of claim 26, wherein the trap-forming segment of the drain line includes a first section extending downwardly from said second segment substantially within the outer frame, and a second section curving in a lateral direction away from the first section and bending upward, the flexible portion of the drain line extending from the second section of the trap-forming segment.

28. The apparatus of claim 18, further comprising an electrical outlet and light means adapted to move with the carrier frame.

29. The apparatus of claim 18, further comprising means for limiting the range of vertical travel of the carrier frame and means for stopping the downward movement thereof when an object impedes said downward movement.

30. A vertically adjustable lavatory assembly comprising:

an outer frame adapted to be positioned substantially within a recess in a wall, said outer frame including spaced apart, vertical side walls;

a carrier frame positioned within the outer frame and being vertically moveable within said outer frame;

a lavatory including a substantially horizontal counter for resting a person's arms or various articles thereon, a faucet, and a sink basin depending from substantially the center of the counter, said lavatory being connected to the carrier frame and positioned outside the carrier frame and outer frame;

an upper cabinet attached to the carrier frame, said upper cabinet including a mirror and being positioned substantially within the carrier frame above the counter;

upper collapsible bellows having a width substantially the same as the distance between the side walls of the outer frame, said upper bellows being adapted to interconnect an upper portion of the upper cabinet to an upper portion of the outer frame;

lower collapsible bellows having a width substantially the same as the distance between the side walls of the outer frame, said lower bellows being adapted to interconnect a lower portion of the lavatory to a lower portion of the outer frame;

means for vertically moving the carrier frame relative to the outer frame;

means for guiding the carrier frame within the outer frame;

control means for actuating vertical movement of the carrier frame;

a drain line including a rigid portion connected to an outlet opening in the basin and a flexible portion connected to a sewer line, the rigid portion having a first segment extending downward from the sink basin outlet opening, a substantially horizontal second segment extending rearwardly from said first segment, and a trap-forming segment extending from said second segment, said second segment being substantially adjacent a bottom surface of the basin to provide maximum clearance between the drain line and a floor, and said trap-forming segment having a first section extending downward from said second segment, and a second section curving in a lateral direction away from the first section and bending upward; and a plurality of flexible supply lines for supplying water to the faucet;

whereby the control means is activated to move the carrier frame and its connected components in a desired vertical direction within the outer frame, and one bellows expands and the other bellows collapses to conceal the outer frame and any exposed components therein when said carrier frame and its connected components are in any vertical position.

31. The apparatus of claim 30, wherein the counter includes spaced apart lower storage members depending from lateral edge portions thereof.

32. The apparatus of claim 30, further comprising a pair of receptacles positioned below the cabinet and behind the sink basin, said receptacles having a front wall depending from a back edge of the counter, a horizontal bottom wall, and a curved back wall, the back walls extending upwardly beyond the height of the counter, whereby various articles can be placed in the receptacles.

33. The apparatus of claim 30, further comprising an electrical outlet and light means adapted to move with the carrier frame.

34. The apparatus of claim 30, further comprising means for limiting the range of vertical travel of the carrier frame and means for stopping the downward movement thereof when an object impedes said downward movement.

35. The apparatus of claim 30, wherein the means for moving the carrier frame is positioned adjacent an upper portion of the outer frame.

36. The apparatus of claim 35, wherein the means for moving the carrier frame comprises a motor attached to the upper portion of the outer frame and a jack screw driven by said motor, the jack screw having a top end portion rotatably attached to a horizontal cross-member of the outer frame and a bottom end portion adapted to threadably mate with an aperture in the carrier frame, whereby the carrier frame and its connected components move vertically relative to the outer frame when the screw is rotated by the motor.

37. The apparatus of claim 36, wherein the carrier frame includes a carriage member, a pair of spaced apart vertical support members, and a bottom horizontal support bracket which supports the lavatory, the carriage member having an aperture therein and a nut attached thereto in alignment with said aperture.

38. The apparatus of claim 30, wherein the means for guiding the carrier frame vertically within the outer frame comprises side pieces connected to said carrier frame which slidably bear against the side walls of the outer frame.

39. A vertically adjustable lavatory assembly comprising:

a rectangular outer frame adapted to be positioned substantially within a recess formed in a wall, said outer frame including vertical side walls, a top horizontal cross-member, and a bottom horizontal cross-member;

a carrier frame positioned within the outer frame and being vertically moveable within said outer frame, said carrier frame including a pair of spaced apart vertical support members, a bottom horizontal support bracket which supports the lavatory, a top horizontal carriage member having an aperture therein adapted to receive a jack screw, and side pieces connected thereto which slidably bear against the side walls of the outer frame for guiding the carrier frame within the outer frame;

a motor attached to an upper portion of the outer frame;

a jack screw adapted to be driven by said motor, the jack screw having a top end portion rotatably attached to the top horizontal cross-member of the outer frame and a bottom end portion adapted to threadably mate with the aperture in the top carriage member of the carrier frame, whereby the carrier frame and its connected components move vertically within the outer frame when the screw is rotated by the motor;

a lavatory including a substantially horizontal counter, a faucet, a sink basin depending from substantially the center of the counter, and lower cabinets having a plurality of drawers depending from lateral edge portions of the counter, said lavatory being connected to the carrier frame and positioned outside the carrier frame and outer frame, and said sink basin having a shroud extending downward therefrom for covering a drain line, the shroud having a cavity defined by a front wall, bottom wall, and side walls;

an upper cabinet attached to the carrier frame, said upper cabinet including a mirror and being positioned substantially inside the carrier frame above the counter;

upper light means positioned above the mirror;

lower light means positioned below the mirror;

an electrical outlet adapted to move with the carrier frame;

upper collapsible bellows having a width substantially the same as the distance between the side walls of the outer frame, said upper bellows being adapted to interconnect an upper portion of the upper cabinet to an upper portion of the outer frame;

lower collapsible bellows having a width substantially the same as the distance between the side walls of the outer frame, said lower bellows being adapted to interconnect a lower portion of the lavatory to a lower portion of the outer frame;

control means for actuating vertical movement of the carrier frame;

means for limiting the range of vertical travel of the carrier frame;

means for stopping the downward movement of the carrier frame when an object impedes said downward movement;

a drain line including a rigid portion connected to an outlet opening in the basin and a flexible portion connected to a sewer line, the rigid portion having a first segment extending downward from the sink basin outlet opening, a substantially horizontal second segment extending rearwardly from said first segment, and a trap-forming segment extending from said second segment, said second segment being substantially adjacent a bottom surface of the basin to provide maximum clearance between the drain line and a floor, and said trap-forming segment having a first section extending downward from said second segment, and a second section curving in a lateral direction away from the first section and bending upward; and a plurality of flexible supply lines for supplying water to the faucet;

whereby the control means is activated to move the carrier frame and its connected components in a desired vertical direction within the outer frame, and one bellows expands and the other bellows collapses to conceal the outer frame and any exposed components therein when the carrier frame and its connected components are in any vertical position.

40. The apparatus of claim 39, further comprising a pair of receptacles positioned below the cabinet and behind the sink basin, said receptacles having a front wall depending from a back edge of the counter, a horizontal bottom wall, and a curved back wall, the back walls extending upwardly beyond the height of the counter, whereby various articles can be place in the receptacles.

41. The apparatus of claim 11, wherein the cover means lies in a vertical plane parallel to and adjacent a vertical plane defined by a front edge of the outer frame.

42. A vertically adjustable lavatory assembly comprising:

an outer frame including a plurality of support members having front edges which define a vertical plane;

a carrier frame positioned substantially behind said vertical plane and being vertically moveable within said outer frame;

a lavatory including a faucet and a sink basin having an outlet opening therein, said lavatory being connected to the carrier frame and positioned substantially outside said carrier frame and outer frame;

a moving mechanism for vertically moving the carrier frame within the outer frame, said moving mechanism being positioned above the carrier frame;

a collapsible cover lying in a substantially vertical plane parallel to and adjacent said vertical plane of the outer frame, said cover being movable with the carrier frame;

a drain line in fluid flow communication with the sink basin outlet opening and a sewer line, said drain line including a rigid portion and a flexible portion, the rigid portion having a first segment extending downward from the sink basin outlet opening, a substantially horizontal second segment extending rearwardly from said first segment, and a trap-forming segment extending from said second segment, said trap-forming segment being positioned behind said vertical plane of the outer frame, and said second segment being substantially adjacent a bottom surface of the basin to provide maximum clearance between the drain line and a floor; and a plurality of supply lines for supplying water to the faucet, the supply lines being adapted to accommodate for changes in the height of the basin.

43. The apparatus of claim 42, wherein the sink basin depends from a substantially horizontal counter having spaced apart lower storage members depending from lateral edge portions thereof.

44. The apparatus of claim 42, further comprising one of a mirror and an upper cabinet positioned above the lavatory and substantially within the carrier frame.

* * * * *

UNITED STATES PATENT AND TRADEMARK OFFICE

CERTIFICATE OF CORRECTION

PATENT NO. : 5,230,109

DATED : July 27, 1993

INVENTOR(S) : GIANFRANCO ZACCAI ET AL.

It is certified that error appears in the above-identified patent and that said Letters Patent is hereby corrected as shown below:

In column 4, line 33, please delete "it" and substitute therefor --its--.

Column 14

In Claim 40, line 7, please delete "place" and substitute therefor --placed--.

Signed and Sealed this

Eleventh Day of July, 1995

Bruce Lehman

*Attest:*

BRUCE LEHMAN

*Attesting Officer*

*Commissioner of Patents and Trademarks*